US009859075B1

(12) United States Patent
Fasano et al.

(10) Patent No.: US 9,859,075 B1
(45) Date of Patent: Jan. 2, 2018

(54) BOTTOM VENTING CIRCUIT BREAKER

(71) Applicants: Michael Fasano, Watertown, CT (US); Steven Tommell, Meriden, CT (US); Nicholas Ryan Goodine, Bristol, CT (US); James Bugryn, Bristol, CT (US)

(72) Inventors: Michael Fasano, Watertown, CT (US); Steven Tommell, Meriden, CT (US); Nicholas Ryan Goodine, Bristol, CT (US); James Bugryn, Bristol, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/395,825

(22) Filed: Dec. 30, 2016

(51) Int. Cl.
*H01H 33/53* (2006.01)
*H01H 33/08* (2006.01)

(52) U.S. Cl.
CPC ..... *H01H 33/53* (2013.01); *H01H 33/08* (2013.01)

(58) Field of Classification Search
CPC ..... H01H 2050/025; H01H 9/443; H01H 50/546; H01H 50/02; H01H 50/54; H01H 1/66; H01H 50/045; H01H 50/443; H01H 1/36; H01H 50/00; H01H 50/30; H01H 50/40; H01H 50/60; H01H 51/00; H01H 51/06

See application file for complete search history.

(56) References Cited

U.S. PATENT DOCUMENTS

| | | | | |
|---|---|---|---|---|
| 3,953,812 | A * | 4/1976 | Heft | H01H 69/01 335/23 |
| 4,650,940 | A * | 3/1987 | Grunert | H01H 9/342 200/304 |
| 8,138,439 | B2 * | 3/2012 | Malingowski | H01H 9/342 218/157 |
| 9,159,508 | B2 * | 10/2015 | Rival | H01H 9/342 |
| 2004/0051605 | A1 * | 3/2004 | Fasano | H01H 9/443 335/35 |
| 2015/0070114 | A1 * | 3/2015 | Fasano | H01H 71/32 335/21 |
| 2017/0047185 | A1 * | 2/2017 | Fasano | H01H 9/0264 |

* cited by examiner

*Primary Examiner* — Truc Nguyen
(74) *Attorney, Agent, or Firm* — St. Onge Steward Johnston & Reens, LLC

(57) ABSTRACT

A circuit interrupter having a first plate on which a stationary contact is positioned where the flow of electrical current through the first contact and first plate cause a magnetic field to form around the stationary contact such that an arc that may form in the vicinity of the stationary contact is urged toward arc extinguishing plate and vented out the bottom of the housing of the circuit interrupter. In one configuration the venting is formed as a split vent path to direct the venting of gas and debris in a controlled manner.

30 Claims, 4 Drawing Sheets

BOTTOM VENTING CIRCUIT BREAKER

FIELD OF THE INVENTION

The invention relates to the field of circuit breakers. More specifically, the invention relates to a circuit breaker that splits and directs the venting of gases caused by arcing that may occur in a circuit interrupter.

BACKGROUND OF THE INVENTION

Circuit interrupters are electrical components that can be used to break an electrical circuit, interrupting the current flow. A basic example of a circuit interrupter is a switch, which generally consists of two electrical contacts in one of two states; either closed, meaning that the contacts are touching and electricity can flow between them, or open, meaning that the contacts are separated, and no electricity can flow between them. A switch may be directly manipulated by a human to provide a control signal to a system, such as a computer keyboard button, or to control power flow in a circuit, such as a light switch.

Another example of a circuit interrupter is a circuit breaker. A circuit breaker may be used, for example, in an electrical panel to limit the electrical current being sent through the electrical wiring. A circuit breaker is designed to protect an electrical circuit from damage caused by an overload or a short circuit. If a fault condition such as a power surge occurs in the electrical wiring, the breaker will trip. This will cause a breaker that was in the "on" position to flip to the "off" position and shut down the electrical power leading from that breaker. When a circuit breaker is tripped, it may prevent a fire from starting on an overloaded circuit; it can also prevent the destruction of the device that is drawing the electricity.

A standard circuit breaker has a terminal connected to a power supply, such as a power line from a power company, and another terminal connected to the circuit that the breaker is intended to protect. Conventionally, these terminals are referred to as the "line" and "load" respectively. The line may sometimes be referred to as the input into the circuit breaker. The load, sometimes referred to as the output, feeds out of the circuit breaker and connects to the electrical components being fed from the circuit breaker.

A circuit breaker may be used to protect an individual device, or a number of devices. For example, an individual protected device, such as a single air conditioner, may be directly connected to a circuit breaker. A circuit breaker may also be used to protect multiple devices by connecting to multiple components through a power wire which terminates at electrical outlets, for example.

A circuit breaker can be used as a replacement for a fuse. Unlike a fuse however, which operates once and then must be replaced, a circuit breaker can be reset (either manually or automatically) to resume normal operation. Fuses perform much the same circuit protection role as circuit breakers. However, circuit breakers may be safer to use in some circumstances than fuses, and may be easier to fix.

For example, in a situation where a fuse blows, interrupting power to a section of a building for example, it may not be apparent which fuse controls the interrupted circuit. In this case, all of the fuses in the electrical panel would need to be inspected to determine which fuse appears burned or spent. This fuse would then need to be removed from the fuse box, and a new fuse would need to be installed.

In this respect, circuit breakers can be much simpler to use than fuses. In a situation where a circuit breaker trips, interrupting power to a section of a building for example, it may be easily apparent which circuit breaker controls the interrupted circuit by looking at the electrical panel and noting which breaker has tripped to the "off" position. This breaker can then be simply flipped to the "on" position and power will resume again.

In general, a typical circuit interrupter has two contacts located inside of a housing. The first contact is stationary, and may be connected to either the line or the load. The second contact is movable with respect to the first contact, such that when the circuit breaker is in the "off" or tripped position, a gap exists between the first and second contact.

A problem with circuit interrupters that operate by separating contacts arises because the energized contacts separate when the circuit breaker is tripped, causing a gap to widen between the contacts while the movable contact moves from the closed position to the open position.

As the contacts begin to separate from the closed position, or approach complete closure from an open position, a very small gap exists between the contacts for a brief time while the contacts are closed or opened. An electric arc may be generated across this gap if the voltage between the contacts is high enough. This is because the breakdown voltage between the contacts is positively related to distance under pressure and voltage conditions in typical applications.

The creation of an arc during switching or tripping the circuit interrupter can result in undesirable side effects which can negatively affect the operation of the circuit interrupter, and which can create a safety hazard.

These effects can have consequences for the operation of the circuit interrupter. One possible consequence is that the arc may short to other objects in the circuit interrupter and/or to surrounding objects, causing damage and presenting a potential fire or electrocution safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius) which can crack the surrounding gas molecules creating ozone, carbon monoxide, and other compounds. The arc can also ionize the surrounding gasses, potentially creating alternate conduction paths.

Various techniques have been used in an attempt to contain and direct the debris and gas caused by arcing. For example, it has been known to vent the gasses out the side of the circuit interrupter. However, when multiple circuit interrupters are installed in a panelboard, load center or the like, the venting of the gas out the side of the circuit breaker has a tendency to direct the gas toward adjacent circuit interrupters. The debris and gas can have an adverse effect on the adjacent devices. One method for attempting to prevent this adverse effect has been the use of a shield on the side of the circuit interrupter to direct the gas and debris away from an adjacent circuit breaker. However, these constructions have had limited success due in part to the extreme angles of redirection, which have a tendency to reduce the effectiveness of the venting process.

A common circuit interrupter configuration provides the electrical connection points (e.g., the connection between the "line" terminal connected to incoming power, and the "load" terminal connected to the device or circuit to receive the electrical power) on the underside of the circuit breaker. The "line" terminal may be a "stab" type terminal (i.e., it is typically formed as two tines that receive a blade therebetween) or a screw type terminal (i.e., the terminal is connected to an electrical bus bar via a screw connection).

It is therefore desired to provide an alternative system that is usable with a circuit interrupter that overcomes these limitations.

SUMMARY OF THE INVENTION

Accordingly, it is an object of the present invention to provide a circuit interrupter that is able to vent debris and gasses caused by arcing away from adjacent circuit interrupters.

It is further desired to provide a circuit interrupter that is able to more effectively and efficiently vent debris and gasses caused by arcing.

It is still further desired to provide a circuit interrupter having a structure and configuration such that the venting of debris and gasses is not directed toward any electrical connection points of the circuit interrupter to avoid corrosion to damage to those electrical connections.

These and other objectives are achieved by providing a circuit interrupter which includes a mechanism oriented in such a manner so as to vent gasses and debris downward (e.g., out the bottom side of the housing of the circuit interrupter opposite from the side that includes the handle). In particular, a portion of the stationary terminal (contact) is positioned in the housing in such a manner that the current flowing through the stationary terminal creates a magnetic field that assists in blowing the arc toward the bottom vent.

It should be noted that the "line" connection for the circuit interrupter is typically located at one end of the bottom of the housing of the circuit interrupter such that it can be electrically connected to a bus bar connected to a source of the electrical power (e.g., in a panel board or load center or other electrical distribution equipment). However, it is undesirable to "blow" the gasses and debris toward or onto the "line" connection point for the circuit interrupter as this can cause the electrical connection to corrode thereby increasing the electrical resistance of the connection. Likewise, circuit interrupters are becoming known that include an additional "neutral" connection to a "neutral bar" that extends down the center of the electrical panelboard or load center within which the circuit interrupter is positioned. It would also be disadvantageous to "blow" gasses and debris onto or toward the connection point where the circuit interrupter is connected to the neutral bus bar for all the reasons stated previously.

Accordingly, a structure is contemplated that "splits" the flow of gasses and debris into two different paths when it is vented out the bottom of the circuit interrupter. For example, the "line" connection on a lower part of the circuit interrupter may be electrically connected to a "line" bus bar and a "neutral" connection on the bottom of the circuit interrupter may also be electrically connected to a "neutral" bus bar. The vent out the bottom of the circuit interrupter could split the path of the gas into two separate paths, where each path extends toward each side of the electrical connection points to the various bus bars so as not to direct the gasses directly at the connection points. So while prior art systems are know that vent out the sides of the housing, this configuration would vent out the bottom of the housing and would be split into two separate vent paths so that the gas and debris are directed so as to avoid impinging on either the line or neutral bus bars.

Because of the detrimental effects of arcing, it can be very important to quickly cool and quench the arc to prevent damage to the circuit interrupter. Accordingly, in some implementations, an arc extinguisher is also utilized to help extinguish an arc that may develop in the gap between the contacts.

In one implementation, the arc extinguisher may comprise an arc runner and at least one arc plate. In addition, the arc runner may include a tab extending below the arc runner. Likewise, the at least one arc plate may comprise a group or series of arc plates that may be placed along a path of the moveable contact. In one configuration, the path of the moveable contact may comprise a radial path. The current flowing through a portion of the stationary contact will produce a magnetic force that can urge the arc in a direction toward the arc plates. The arc plates will be positioned in a manner such that the gas and debris may be vented downward out the bottom of the housing, and may further comprise two separate vent paths.

For this application the following terms and definitions shall apply:

The term "network" as used herein includes both networks and internetworks of all kinds, including the Internet, and is not limited to any particular network or inter-network.

The terms "first" and "second" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

In one embodiment, a circuit interrupter is provided comprising a line terminal connectable to a source of electrical power, a load terminal connectable to a load, and a stationary contact positioned on a first plate. The circuit interrupter further comprises a second plate connected at a first end to and extending substantially perpendicular from the first plate, and a moveable contact arm having a moveable contact positioned thereon, the moveable contact configured to be moveable into and out of physical contact with the stationary contact by movement of the moveable contact arm. The circuit interrupter still further comprises a current measurement device connected in series with the stationary contact and the line terminal, and a handle coupled to a linkage, the linkage coupled to the moveable contact arm, wherein movement of the handle causes the linkage to move the moveable contact arm to open and close the moveable contact with respect to the stationary contact. The circuit interrupter is provided such that the electrical current flowing through the first contact causes a first magnetic field to be formed in a clockwise direction relative to the first contact such that an arc that forms in the vicinity of the first contact is travels an arc path in a direction away from the second plate.

In another embodiment, a circuit interrupter having a housing within which the components of the circuit interrupter are contained is provided comprising a line terminal, a load terminal, and a stationary contact mounted on a first plate. The circuit interrupter further comprises a moveable contact arm having a moveable contact positioned thereon, the moveable contact configured to be moveable into and out of contact with the stationary contact by movement of the moveable contact arm, and a second plate a extending substantially perpendicular from a side of the first plate. The circuit interrupter is provided such that the electrical current flowing through the first contact causes a first magnetic field to be formed in a clockwise direction relative to the first contact such that an arc that forms in the vicinity of the first contact is drawn toward an arc path that extends in a direction away from the second plate. The circuit interrupter still further comprises an opening in the housing for venting of the arc.

Other objects of the invention and its particular features and advantages will become more apparent from consideration of the following drawings and accompanying detailed description.

DETAILED DESCRIPTION OF THE INVENTION

Figure 1:
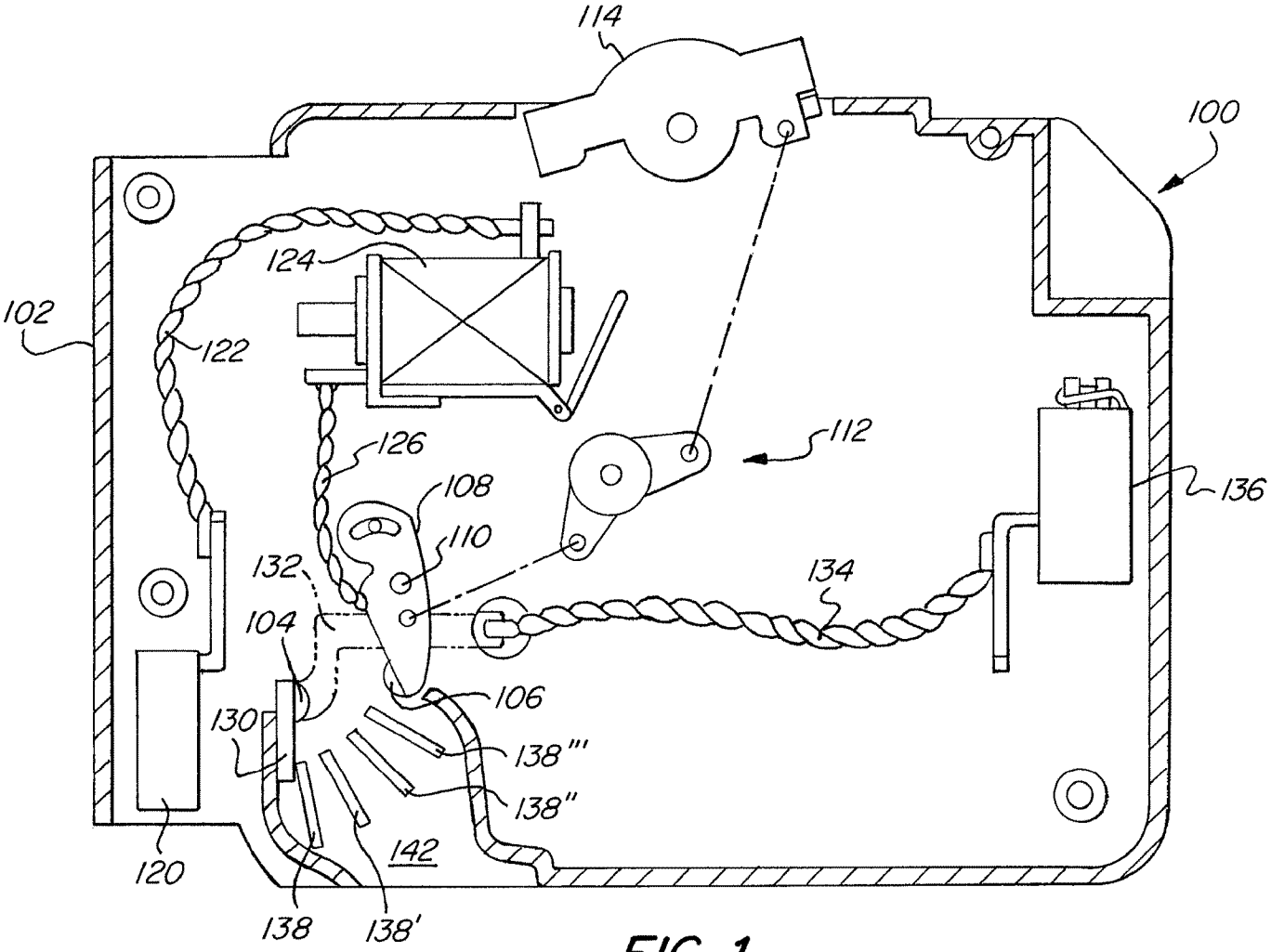
FIG. 1 is an illustration of one aspect of the circuit interrupter according to the invention.

Referring now to the drawings, wherein like reference numerals designate corresponding structure throughout the views.

FIG. 1 illustrates components of an example circuit interrupter 100 having a stationary and a moveable contact in a bottom vent configuration according to aspects of the invention.

Circuit interrupter 100 is provided with a housing 102 that contains the working elements of the device. The circuit interrupter is further provided with a set of contacts including a stationary contact 104 and movable contact 106. The moveable contact 106 is positioned on a moveable contact arm 108 that is designed to pivot about an axis 110.

The moveable contact arm 108 is coupled to a handle 114 via a linkage assembly 112. The moveable contact arm 108 is configured to move between an open and closed position relative to the stationary contact 104 by manual actuation of the handle 114 as is known in the art.

Also shown in FIG. 1 is a "line" terminal 120, which is designed to be connected to a source of electrical power, such as a bus bar in a panel board or load center. The line terminal 120 is provided with a connection 122 that electrically connects the line terminal 120 to a current measurement device 124. Current measurement device 124 is, in turn, connected to moveable contact arm 108 via connection 126.

Stationary contact 104 is mounted onto a first plate 130, which in turn has a second plate 132 affixed thereto at one end and a connection 134 attached at a second end that couples stationary contact to "load" terminal 136.

In operation, electrical power is input into circuit interrupter 100 via line terminal 120, which passes through current measurement device 124. If the electrical current exceeds a threshold level, current measurement device 124 will function to "trip" the circuit interrupter 100 by opening the circuit (opening the contacts relative to each other) such that the flow of electrical current through the contacts ceases. In the event that the electrical current does not exceed the threshold level set by current measurement device 124, the electrical power is coupled to load terminal 136, which in turn, provides electrical power to the connected circuit and/or equipment.

Figure 3:
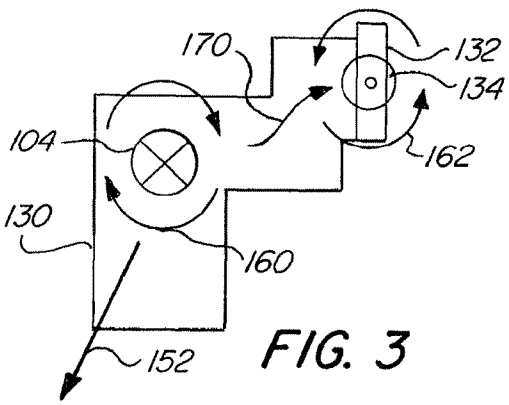
FIG. 3 is a view along Section A-A according to FIG. 2.
Figure 2:
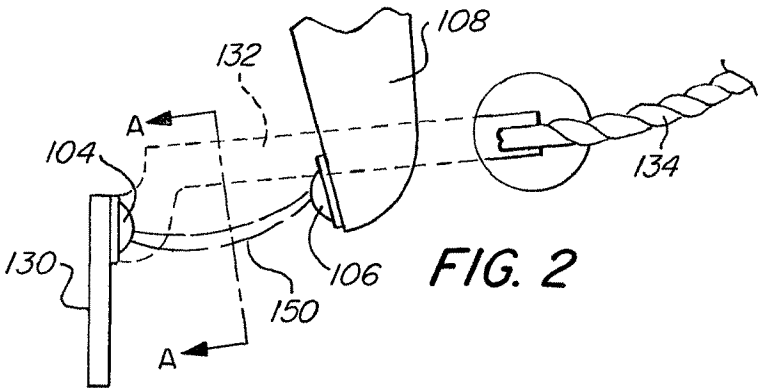
FIG. 2 is partial view of a portion of the circuit interrupter according to FIG. 1.
Figure 4:
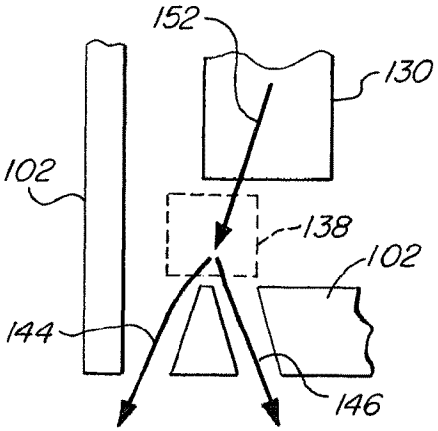
FIG. 4 is a view of a portion of the circuit interrupter according to FIG. 3.

Turning now to FIGS. 2-4, the contacts are shown in greater detail. FIGS. 2 and 3 show the configuration of the first plate 130 relative to the second plate 132. In the event that moveable contact arm 108 rotates moveable contact 106 away from stationary contact 104, if electrical current is flowing through the contacts, it is likely that an electrical arc 150 will develop across the gap between the contacts. As has been previously discussed, the electrical arc that develops may cause damage to the circuit interrupter 100 and in particular, to the contacts and surroundings mechanisms. Accordingly, it is highly desirable to move the arc off of the contacts as quickly and efficiently as possible.

Referring to FIG. 3, the stationary contact 104 mounted on first plate 130 is illustrated. As can be seen FIG. 3 is a view along section line A-A of FIG. 2. For illustrative purposes, it is assumed that the contacts are in a closed position and electrical current is flowing through stationary contact 104. Stationary contact 104 is illustrated having two arrows in a circular clockwise pattern, which are provided to represent magnetic field 160. As electrical current (170) flows through stationary contact 104 and travels through first plate 130 and into second plate 132, it will be understood that the magnetic field 160 will form in the pattern indicated. Likewise, when electrical current flows through second plate 132, a magnetic field 162 will be formed that will rotate in a counterclockwise direction (relative to stationary contact 104) as indicated in FIG. 3.

The generation of the magnetic field(s) will function to urge the arc 150 to travel along an arc extinguishing path 152 as indicated in FIG. 3. Referring now back to FIG. 1, arc plates (138, 138', 138", 138'") are also illustrated in the vicinity of the contacts.

Moveable contact arm 108 is designed to move moveable contact 106 in a radial path about pivot 110. Arc plates (138, 138', 138", 138'") are positioned along the radial path of movement such that if an arc develops in the gap between the contacts (e.g., when the contacts are opening) the arc will be drawn toward one or more of the arc plates (138, 138', 138", 138'"). The positioning of the arc plates (138, 138', 138", 138'") is contemplated to electromagnetically draw the arc into the arc plates (138, 138', 138", 138'"). These components are at least partially enclosed by housing 102.

Also illustrated in FIG. 1 is vent 142 positioned at a bottom portion of the circuit interrupter 100. Vent 142 is provided to allow gasses and debris that may form due to the generation of an arc 150, to escape from the interior of the housing 102 of circuit interrupter 100. The vent 142 is positioned at a bottom of the housing 102 so that none of the gas or debris is vented toward an adjacent circuit interrupter that may be positioned in the same enclosure as circuit interrupter 100. As stated previously, it would be disadvantageous to vent the gas or debris in a manner that could possibly damage or degrade adjacent devices and/or electrical contacts.

Referring to the corresponding structures in FIGS. 2-4, the arc 150 is urged away from the stationary contact 104 to travel along an arc path 152 due in part to the magnetic field 160 and the positioning of the arc plates (138, 138', 138", 138'''). When the arc 150 is driven along the arc extinguishing path 152 into the arc plates (138, 138', 138", 138'''), this will function to quickly and efficiently extinguish the arc 150. The associated gas and debris will be vented out of vent 142.

Figure 5:
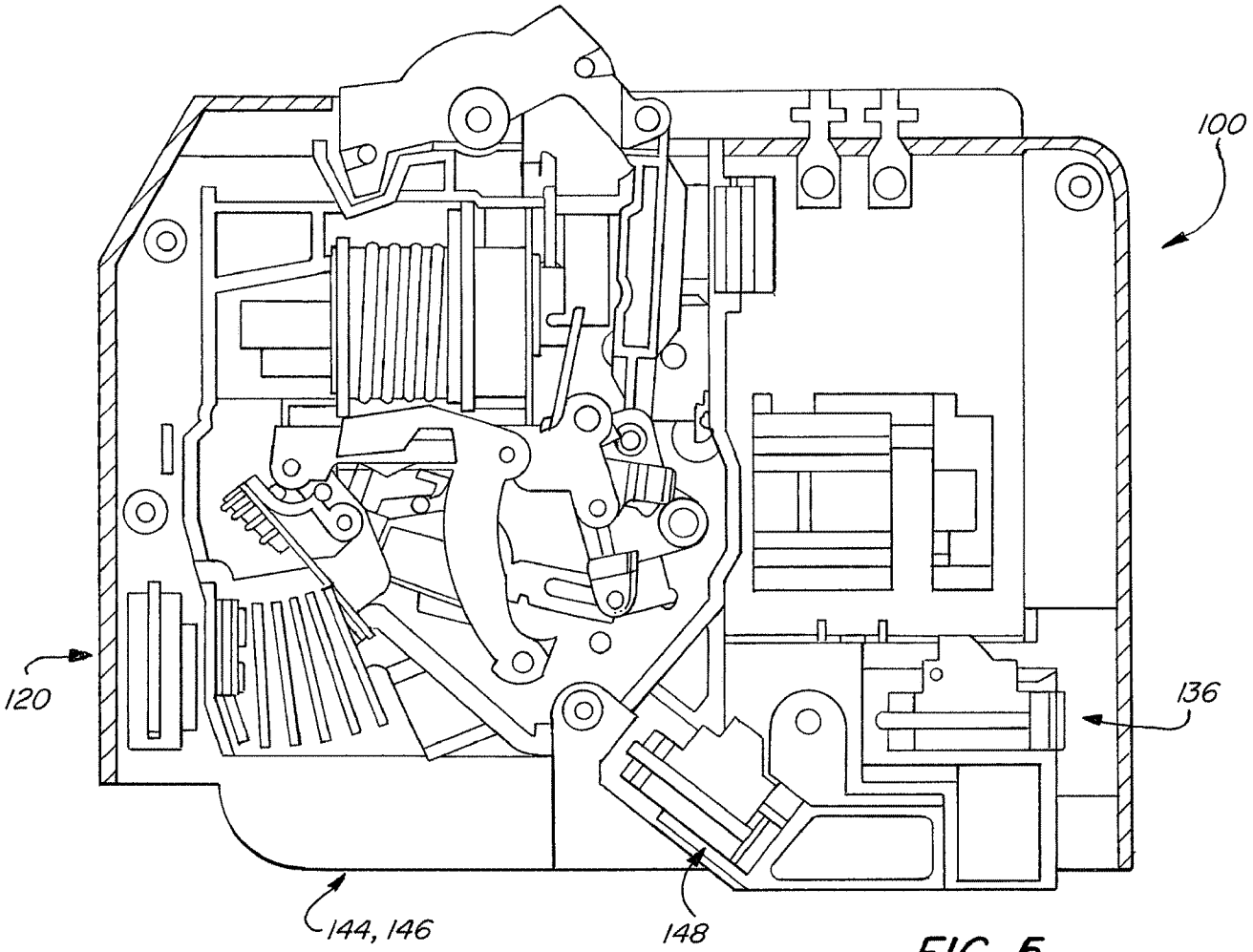
FIG. 5 is an illustration of another aspect of the circuit interrupter according to FIG. 1.

Turning now to FIG. 5, in some configurations, it is contemplated that a neutral connection may be provided on a bottom surface of circuit interrupter 100. For example, while it has been common practice to wire a neutral wire to a neutral bar in an electrical panel or load center, when a typical circuit breaker is removed only the line is disconnected going out to the equipment, whereas the neutral remains connected to the neutral bus. A relatively new type of configuration allows for the circuit interrupter 100 to include a connection to a neutral bus so that both the "hot" and the "neutral" wires feeding a circuit are connected to the circuit interrupter. So while the "line" terminal 120 is shown at a bottom end of the housing for connection to a source of electrical power (not shown), a "neutral" terminal (148) may be positioned on the underside (bottom) of the housing in the vicinity of the vent 142. However, this raises the issue of venting gas and debris toward the location where the neutral terminal of the circuit interrupter 100 contacts the neutral bar in the panelboard. To address this problem a new configuration is illustrated in FIG. 4 in which the gas and debris is split into two separate vent paths 144, 146 such that gas and debris are vented in the manner illustrated by the arrows shown in FIG. 4.

Figure 6:
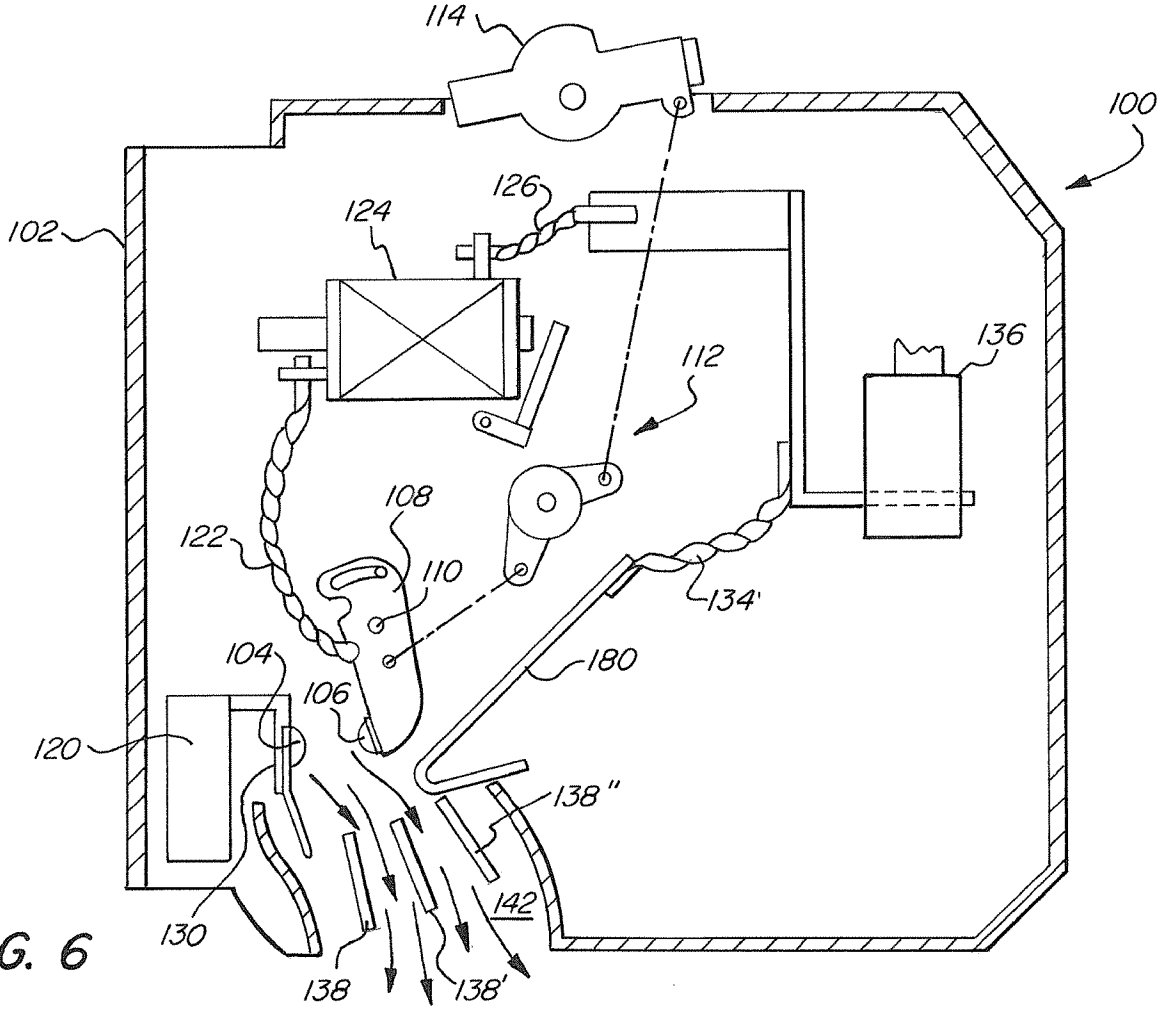
FIG. 6 is an illustration of another aspect of the circuit interrupter according to FIGS. 1 and 5.

Referring now to FIG. 6, circuit interrupter 100 is illustrated including many of the features described in connection with FIG. 1. Line terminal 120 is illustrated comprising a plate 130 on which stationary contact 104 is located. A moveable contact arm 108 is provided that has a moveable contact 106 located thereon that is moved into and out of contact with stationary contact 104 to open and close the circuit as discussed in connection with FIG. 1. A connection 122 extends from the moveable contact arm 108 to current measurement device 124, which is in turn, electrically connected to load terminal 136 via connection 126.

Also illustrated in FIG. 6 is connection 1134', which connects load terminal 136 to arc runner 180. Those of skill in the art will understand that lower arc runner 180 may be connected in a number of different configurations as desired without departing from aspects of the invention.

Arc plates (138, 138', 138", 138''') are positioned in the vicinity of stationary contact 104 and moveable contact 106 and are provided to drawn an arc that may develop between the contacts toward the arc plates (138, 138', 138", 138''') where any gas and debris can be vented out vent 142. These components are at least partially enclosed by housing 120.

The vent 142 is positioned on a bottom of the housing 102, which is opposite to handle 114 positioned on housing 102. In this manner, gasses and debris that may be created due to arcing will be vented out of the bottom of the housing and not toward any adjacent circuit interrupters that may be positioned in, for example, a panelboard or other electrical enclosure. A major benefit of this configuration is that the arc is drawn directly toward the vent 142 such that the gas and debris our vented on a straight and direct path out of the housing 102 and substantially in line with the positioning of the arc plates (138, 138', 138", 138'''). This provides the least amount of resistance to the venting processes to efficiently and effectively remove any caustic gas (illustrated in FIG. 6 as arrows in vent 142 that show the flow of gas from the contacts, through the vent 142 and exiting from housing 102) that could damage the internal mechanisms of the circuit interrupter 100.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter having a housing within which the components of the circuit interrupter are contained, the circuit interrupter comprising:

a line terminal connectable to a source of electrical power;

a load terminal connectable to a load;

a stationary contact positioned on a first plate;

a second plate connected at a first end to and extending substantially perpendicular from said first plate;

a moveable contact arm having a moveable contact positioned thereon, said moveable contact configured to be moveable into and out of physical contact with said stationary contact by movement of said moveable contact arm, wherein said line terminal and said load terminal are in electrical communication via said stationary contact and said moveable contact when said stationary contact and said moveable contact are in physical contact;

a current measurement device connected in series with said line terminal and said load terminal;

a handle disposed on a first surface of said housing and coupled to a linkage, said linkage coupled to said moveable contact arm, wherein movement of said handle causes said linkage to move said moveable contact arm to open and close the moveable contact with respect to said stationary contact;

wherein electrical current flowing through the first contact causes a first magnetic field to be formed in a clockwise direction relative to said first contact such that an arc that forms in the vicinity of said first contact is urged to travel an arc path in a direction away from said second plate, and wherein an opening is positioned in a second surface of said housing, said second surface being disposed on an opposite side of said housing as is said first surface, and wherein said opening provides a vent path for the venting of gas caused by the arc, said vent path being split so as to define two separate vent paths.

2. The circuit interrupter of claim 1, wherein said first plate further comprises a first side that includes a protrusion and said second plate is connected to said protrusion.

3. The circuit interrupter of claim 2, wherein said second plate is formed in the shape of a dog-leg.

4. The circuit interrupter of claim 2, wherein when said first and second contacts are in a closed position, electrical current flows through said first contact through said first plate and into said second plate.

5. The circuit interrupter of claim 4, wherein the electrical current flowing through said second plate forms a second magnetic field that rotates counter clockwise with respect to said first magnetic field.

6. The circuit interrupter of claim 2, wherein an arc plate is positioned in the arc path such that the arc is urged from the contacts toward the arc plate.

7. The circuit interrupter of claim 6, wherein the arc plate comprises a plurality of arc plates.

8. The circuit interrupter of claim 7, wherein said moveable contact arm moves said moveable contact along a radial path and the plurality of arc plates are positioned along the radial path.

9. The circuit interrupter of claim 1, wherein said opening provides a vent path for the venting of gas caused by the arc, the gas traveling along the vent path and exiting said housing in a substantially straight path.

10. The circuit interrupter of claim 1, further comprising a neutral terminal positioned on the side of said housing on which said opening is positioned.

11. The circuit interrupter of claim 10, wherein said two separate vent paths are configured such that gas is not vented directly onto said neutral terminal.

12. A circuit interrupter having a housing within which the components of the circuit interrupter are contained, the circuit interrupter comprising:

a line terminal;

a load terminal;

a stationary contact mounted on a first plate;

a moveable contact arm having a moveable contact positioned thereon, said moveable contact configured to be moveable into and out of contact with said stationary contact by movement of said moveable contact arm, wherein said line terminal and said load terminal are in electrical communication via said stationary contact and said moveable contact when said stationary contact and said moveable contact are in contact;

a second plate a extending substantially perpendicular from a side of said first plate;

wherein electrical current flowing through the first contact causes a first magnetic field to be formed in a clockwise direction relative to said first contact such that an arc that forms in the vicinity of said first contact is drawn toward an arc path that extends in a direction away from said second plate; and an opening in the housing providing a vent path for venting of the arc said vent path being split so as to define two separate vent paths.

13. The circuit interrupter of claim 12, wherein said first plate further comprises a first side that includes a protrusion and said second plate is connected to said protrusion.

14. The circuit interrupter of claim 13, wherein said protrusion second plate is formed in the shape of a dog-leg.

15. The circuit interrupter of claim 13, wherein the electrical current flowing through said second plate forms a second magnetic field that rotates counter clockwise relative to said first contact.

16. The circuit interrupter of claim 12, further comprising a current measurement device connected in series with said line terminal and said load terminal.

17. The circuit interrupter of claim 12, further comprising a handle coupled to a linkage, said linkage coupled to said moveable contact arm, wherein movement of said handle causes said linkage to move said moveable contact arm to open and close the moveable contact with respect to said stationary contact.

18. The circuit interrupter of claim 12, wherein an arc plate is positioned in the arc path such that the arc is urged from the contacts toward the arc plate.

19. The circuit interrupter of claim 18, wherein the arc plate comprises a plurality of arc plates.

20. The circuit interrupter of claim 19, wherein said moveable contact arm moves said moveable contact along a radial path and the plurality of arc plates are positioned along the radial path.

21. The circuit interrupter of claim 18, wherein the opening is positioned on a side of said housing opposite to a side of said housing that holds said handle.

22. The circuit interrupter of claim 21, wherein said opening provides a vent path for the venting of gas caused by the arc, the gas traveling along the vent path and exiting said housing in a substantially straight path.

23. The circuit interrupter of claim 21, further comprising a neutral terminal positioned on the side of said housing on which said opening is positioned.

24. The circuit interrupter of claim 23 wherein said two separate vent paths are configured such that gas is not vented directly onto said neutral terminal.

25. A circuit interrupter having a housing within which the components of the circuit interrupter are contained, the circuit interrupter comprising:

a line terminal operable to be connected to a source of electrical power;

a load terminal operable to be connected to an attached load;

a stationary contact mounted on a first plate;

a moveable contact arm having a moveable contact positioned thereon, said moveable contact configured to be moveable into and out of contact with said stationary contact by movement of said moveable contact arm, wherein said line terminal and said load terminal are in electrical communication via said stationary contact and said moveable contact when said stationary contact and said moveable contact are in physical contact;

a current measurement device connected in series between said line terminal and said load terminal;

a handle disposed on a first surface of said housing and coupled to a linkage, said linkage coupled to said moveable contact arm, wherein movement of said handle causes said linkage to move said moveable contact arm to open and close the moveable contact with respect to said stationary contact;

an arc extinguisher for extinguishing an arc that develops in the vicinity of said first and second contacts, said arc extinguisher including an arc runner and a plurality of arc plates positioned in the vicinity of said contacts; and an opening in the housing for venting of gas caused by an arc, said opening positioned in a second surface of said housing, said second surface being disposed on an opposite side of said housing as is said first surface;

wherein said plurality of arc plates are positioned in the vicinity of said opening and wherein said opening provides a vent path for the venting of gas caused by the arc, said vent path being split so as to define two separate vent paths.

26. The circuit interrupter of claim 25, wherein said contact arm rotates about a pivot and moves said moveable contact along a radial path, wherein said arc plates are positioned along the radial path.

27. The circuit interrupter of claim 26, wherein the arc is drawn toward one end of at least one of the plurality of arc plates and the gas is drawn along the path of the arc toward said at least one of the plurality of arc plates, the gas passing between the plurality of arc plates an out through said opening along an essentially straight path.

28. The circuit interrupter of claim 27, wherein said arc runner includes a tab that extends at an acute angle relative to said arc runner, said tab extending substantially perpendicular to at least one of said plurality of arc plates.

29. The circuit interrupter of claim 25, further comprising a neutral terminal positioned on the side of said housing on which said opening is positioned.

30. The circuit interrupter of claim 29, wherein said two separate vent paths are configured such that gas is not vented directly onto said neutral terminal.

* * * * *